United States Patent [19]

Peterson

[11] 4,032,417

[45] June 28, 1977

[54] ELECTROLYTIC PROCESSES

[75] Inventor: John A. Peterson, Niagara Falls, N.Y.

[73] Assignee: Hooker Chemicals & Plastics Corporation, Niagara Falls, N.Y.

[22] Filed: Sept. 3, 1974

[21] Appl. No.: 502,478

[52] U.S. Cl. ..... 204/98; 204/290 F

[51] Int. Cl.[2] ..... C25B 1/34; C25B 11/08; C25B 11/10

[58] Field of Search ..... 204/290 F, 98

[56] References Cited

UNITED STATES PATENTS

| | | | |
|---|---|---|---|
| 3,502,506 | 3/1970 | Broyde | 136/86 |
| 3,663,414 | 5/1972 | Martinsons et al. | 204/290 F |
| 3,773,555 | 11/1973 | Cotton et al. | 204/290 F X |
| 3,804,740 | 4/1974 | Welch | 204/290 R |

FOREIGN PATENTS OR APPLICATIONS

| | | | |
|---|---|---|---|
| 1,164,477 | 12/1966 | United Kingdom | 204/290 F |

*Primary Examiner*—F.C. Edmundson
*Attorney, Agent, or Firm*—Peter F. Casella; Herbert W. Mylius

[57] ABSTRACT

The electrolysis of aqueous alkali metal chloride solutions wherein chlorine is liberated at the anode, is improved through the use of an anode comprising a valve metal substrate, a coating thereon of conductive oxide bronze, and an outer coating of a noble metal oxide.

10 Claims, No Drawings

ELECTROLYTIC PROCESSES

BACKGROUND OF THE INVENTION

The present invention relates to improved electrodes particularly adapted for use as anodes in electrochemical process involving the electrolysis of brines.

A variety of materials have been tested and used as chlorine anodes in electrolytic cells. In the past, the material most commonly used for this purpose has been graphite. However, the problems associated with the use of graphite anodes are several. The chlorine overvoltage of graphite is relatively high, in comparision for example with the noble metals. Furthermore, in the corrosive media of an electrochemical cell graphite wears readily, resulting in substantial loss of graphite and the ultimate expense of replacement as well as continued maintenance problems resulting from the need for frequent adjustment of spacing between the anode and cathode as the graphite wears away. The use of noble metals and noble metal oxides as anode materials provides substantial advantages over the use of graphite. The electrical conductivity of the noble metals and oxides is substantially higher and the chlorine overvoltage substantially lower than that of graphite. In addition, the dimensional stability of the noble metals and noble metal oxides represents a substantial improvement over graphite. However, the use of noble metals or oxides thereof as a major material of construction in anodes results in an economic disadvantage due to the excessively high cost of such materials.

In attempts to avoid the use of the expensive noble metals various other anode materials have been proposed for use as coatings over valve metal substrates. In German Offenlegungsschrift No. 2,210,065, for example, it is disclosed that perovskite compositions, including oxide bronzes, can be formed as coatings on a valve metal substrate to form an anode useful in electrochemical processes.

The oxide bronzes are non-stoichiometric compounds which may be characterized by the formula $A_xBO_3$ where A may be an alkali metal, an alkali-earth metal, a lanthanide, or other, generally having an ionic radius of between about 0.60 and about 1.40A; B is typically tungsten, niobium, molybdenum, tantalum, titanium or vanadium; and x may range from greater than 0 to less than 1.0. The oxide bronzes were first reported (as tungsten bronzes) by Wohler in 1824. They are neither alloys nor intermetallic compounds. The term "bronze" was originally applied to describe the yellow, metallic bronze-like luster of $Na_xWO_3$ where $x$ is about 0.8 to 0.9. However, the term bronze or oxide bronze is now generally applied to this type of composition regardless of color or luster and, depending on the identity of the B metal ion in the formula $A_xBO_3$ may be variously referred to as tungsten bronze, vanadium bronze, or the like. The oxide bronzes are reported as possessing excellent chemical stability and unusually high electrical conductivity ranging from that of a semiconductor to that of a metal.

In the electrolytic production of chlorine, anodes of oxide bronze provide the advantage of economy in the elimination of the use of expensive noble metals. However, the oxide bronze compositions although useful as an anode material exhibit a chlorine overvoltage that is substantially higher than that of the noble metals or noble metal oxides. Thus, despite the elimination of expensive noble metals, the cost of chlorine production, in processes using such anodes, is relatively high. It has further been proposed, according to British Pat. No. 1,164,477, to prepare electrodes of tungsten bronze by heating and vaporizing metallic tungsten, sodium tungstate and tungsten trioxide then allowing the vapors to deposit on a cooled metallic plate. The sodium tungsten bronze may then be used as formed or may be pulverized and sintered in any shape or a metal such as platinum, palladium, iridium, rhodium or silver may be electrodeposited on it. The electrodes are especially useful in processes such as the electrolytic oxidation of methanol in an acidic solution. However, the use of such an electrode as an anode in chlor-alkali cells presents certain problems. Firstly, it has been found that coatings of noble metals such as platinum, ruthenium, or palladium deteriorate in the anodic environment of a chlor-alkali cell at an undesirable rate. For example, the deterioration of such noble metal coatings is substantially faster than that of coatings of the noble metal oxides. Secondly, despite statements in the literature indicating a high degree of chemical stability of alkali metal tungsten bronzes, especially in acid environments, it has been found that, in the anodic environment of a chlor-alkali cell, these compositions deteriorate at a rate which, although much slower than many materials, e.g., steel, copper, and the like, is nevertheless uneconomical and precludes their commercial use as a primary operative anode material for such cells. If such compositions are employed as coatings over a metal substrate, the substrate is ultimately exposed to the anode environment.

Considerable effort has been expended in recent years in attempts to develop improved anode materials and structures utilizing the advantages of noble metals or noble metal oxides. A great amount of effort has been directed to the development of anodes having a high operative surface area of a noble metal or noble metal oxide in comparison with the total quantity of the material employed. This may be done, for example, by employing the noble metal as a thin film or coating over an electrically conductive substrate. However, when it is attempted to minimize the aforementioned economic disadvantage of the noble metals by applying them in the form of very thin films over a metal substrate, it has been found that such very thin films are often porous. The result is an exposure of the substrate to the anode environment, through the pores in the outer layer. In addition, in normal use in a chlor-alkali cell, a small amount of chemical attack, wear, spalling or flaking off of portions of the noble metal or noble metal oxide is likely to occur, resulting in further exposure of the substrate. In general such problems are somewhat more severe with respect to coatings of noble metals than with noble metal oxides. Many materials, otherwise suitable for use as a substrate are susceptible to chemical attack and rapid deterioration upon exposure to the anode environment. In an attempt to assure minimum deterioration of the substrate under such circumstances, anode manufacturers commonly utilize a valve metal such as titanium as the substrate material. Upon exposure to the anodic environment, titanium, as well as other valve metals, will passivate, that is, form a surface layer of oxide which serves to protect the substrate from further chemical attack. The oxide thus formed, however, is non-conductive and is not catalytically active. While this passive oxide layer serves to protect the exposed areas of metal, some chemical attack can take place during long term use and cause dissolution of substrate metal and undercutting of the coating. As a result the operative surface area of the anode is decreased, and the efficiency of the cell is lowered. The more rapidly such passivation occurs, the more frequently the anode must be replaced.

Accordingly, it is an object of the present invention to provide improved electrodes for use as anodes in electrolytic processes. It is a further object to provide such anodes having an operative surface of noble metal oxide and having improved maintenance characteristics.

STATEMENT OF INVENTION

In accordance with the present invention, the method of electrolyzing aqueous metal chloride solutions whereby chlorine is liberated at the anode, is improved through the use of an anode which comprises a valve metal substrate, a coating of an oxide bronze on the surface thereof, and an outer coating, on the surface of the oxide bronze of a noble metal oxide. Anodes of this type exhibit a high degree of durability in addition to the relatively low overvoltage characteristics of a noble metal oxide, making them well-suited for use as anodes in the electrolytic production of chlorine.

Among the advantages of such construction is the protection afforded the metal substrate by the coating of conductive oxide bronze. The substrate materials of the anodes of the invention are the valve metals, such as titanium, tantalum, nobium or zirconium, preferably titanium. The oxide bronze coating, which may range in coating weight from about 0.1 grams per square meter to 100 grams per square meter or more, depending on the degree of protection desired, prevents contact of the substrate and the electrolyte, thus preventing or minimizing corrosion or surface oxidation and the attendant deterioration or passivation of the substrate. At the same time, the outer layer provides the advantageous catalytic properties of the noble metal oxides. In addition, the protective layer of conductive oxide bronze permits the use of a relatively thin layer of the noble metal oxide and a consequent savings resulting from a minimal use of the precious metal. Typically, the layer of noble metal oxide will have a coating weight in the range of about 0.1 grams per square meter to about 20 grams per square meter or higher and preferably about 3 to 10 grams per square meter in thickness. The disadvantage of pores or pinholes in the noble metal layer common in extremely thin layers is obviated by the presence of the intermediate layer of oxide bronze. Pores or pinholes in the noble metal layer, or wearing away of that outer layer over long periods of use result in the gradual exposure of the oxide bronze layer. The intermediate layer of oxide bronze will continue to provide a catalytically active surface in those exposed areas. The catalytic characteristics of the oxide bronzes, although not as high as the noble metals or noble metal oxides, is quite substantially higher than the valve metal oxide. Thus, the overall deterioration of the catalytic properties of the anode is more gradual and maintenance problems are accordingly lessened. It has further been found that the adhesion of the noble metal or noble metal oxide to the substrate is increased by the presence of the intermediate layer of oxide bronze and the problem of spalling of the surface layer is thereby reduced.

DESCRIPTION OF THE PREFERRED EMBODIMENTS

The valve metal substrate which forms the inner or base component of the electrode is an electroconductive metal having sufficient mechanical strength to serve as a support for the coating and having a high degree of chemcial resistivity, especially to the anodic environment of electrolytic cells. Typical valve metals include, for example, Ti, Ta, Nb, Zr, and alloys thereof. The valve metals are well known for their tendency to form an inert oxide film upon exposure to an anodic environment. The preferred valve metal, based on cost and availability as well as electrical and chemical properties is titanium. The conductivity of the substrate may be improved, if desired, by providing a central core of a highly conductive metal such as copper. In such an arrangement, the core must be electrically connected to and completely protected by the valve metal substrate.

Oxide bronzes can be readily formed as an adherent coating on a valve metal substrate, in a manner described hereinafter, to provide a protective, electrically conductive layer over the valve metal substrate. As the relatively thin outer layer of noble metal wears during normal cell use, the intermediate layer of oxide bronze will continue to provide a catalytic surface and delay chemical attack and passivation of the valve metal substrate, thus extending the useful life of the anode and decreasing the frequency with which the cell must be inactivated for replacement of the anode.

Various known methods may be employed in the preparation of oxide bronze coatings. For example, the material may be formed in bulk, then crushed to a powder form, slurried in a suitable liquid carrier or binder, applied to the valve metal substrate by spraying, brushing, rolling, dipping or other suitable method, and heated to decompose or volatilize the liquid and sinter the resultant oxide bronze coating. Suitable volatile carriers for such purposes include, for example, organic solvents such as toluene, benzene, ethanol and the like. Preferably a suitable binder such as a thermally decomposable ester of the B metal is employed. Alternatively, the oxide bronze composition may be formed in situ on the valve metal substrate, for example, by applying a solution or slurry of appropriately selected metal compounds of A and B, proportioned to provide the stoichiometry desired in the final compound, then heating in a reducing atmosphere. For example, a coating solution or slurry may be prepared from a salt of tungsten, vanadium, molybdenum or other "B" metal and inorganic compound of the desired A metal, in the desired proportions. Suitable compounds for this purpose include, for example, "A" metal nitrates, nitrites, carbonates, hydroxides, tungstates, vanadates, molybdates, niobates, titanates, tantalates and the like. The stoichiometry of the coating slurry may be adjusted if needed by addition of a calculated amount of a suitable B metal compound such as tungstic acid, vanadic acid, tantalic acid, molybdic acid, niobic acid or the like.

Various conductive oxide bronze compositions may be employed in the coatings in accordance with this invention, the preferred compositions are the tungsten bronzes and in particular the alkali metal tungsten bronzes. The alkali metal tungsten bronzes are characterized by the formula $M_xWO_3$ where M is an alkali metal and the value of $x$ is greater than 0 and less than 1.0. The ranges of value of $x$ will vary with the different alkali metals. For example, where M is rubidium the valve of x will be between 0 and 0.3; for cesium, $x$ may be between 0 and about 0.25. When $x$ is potassium or lithium, $x$ may be between 0 and about 0.4. When sodium tungsten bronze is employed as the coating, that is $Na_xWO_3$, the value of x may be between about 0.2 and 0.96.

The outer coating of the anode comprises a noble metal oxide such an oxide of platinum, iridium, rhodium, palladium, ruthenium or osmium or mixtures thereof. An outer coating of a noble metal oxide may be applied by known methods such as electroplating, chemical deposition from a solution containing a platinum group compound, spraying, or other methods. The noble metal oxide coating may be applied by first depositing the noble in the metallic state and then oxidizing the noble metal coating, for example, by galvanic oxidation or chemical oxidation by means of an oxidant such as an oxidizing salt melt, or by heating to an elevated temperature, e.g., 300° C to 600° C or higher in an oxidizing atmosphere such as air or oxygen, at atmospheric or superatmospheric pressures to convert the noble metal coating to a coating of the corresponding noble metal oxide. Other suitable methods include, for example, electrophoretic deposition of the noble metal oxide; or application of a dispersion of the noble metal oxide in a carrier, such as alcohol, by spraying, brushing, rolling, dipping, painting, or other method onto the oxide bronze surface followed by heating at an elevated temperature to evaporate the carrier and sinter the oxide coating. A preferred method for the formation of the noble metal oxide coating involves coating the conductive oxide bronze surface with a solution of a noble metal compound, evaporating the solvent and converting the coating of a noble metal compound to the oxide by chemical or electrochemical reaction. For example, the oxide bronze surface may be coated with a solution of a thermally decomposable salt of a noble metal, such as a solution of a noble metal halide in an alcohol, evaporation of the solvent, followed by heating at an elevated temperature such as between about 300° C and 800° C in an oxidizing atmosphere such as air or oxygen for a period of time sufficient to convert the noble metal halide to a noble metal oxide. The procedure for formation of a noble metal oxide coating may be repeated as often as necessary to achieve the desired thickness. The foregoing and other methods for the preparation of coatings of noble metal oxides are well known in the art and may be found for example in U.S. Pat. No. 3,711,385.

The following specific examples will serve to further illustrate this invention. In the examples and elsewhere in this specification and claims, all temperatures are in degrees Celsius and all parts and percentages are by weight unless otherwise indicated.

EXAMPLE IA

A titanium coupon was cleaned and etched by dipping in hot oxalic acid. The etched titanium coupon (1 inch by 3 inch) was coated with a slurry composed of 5.00 grams of $H_2WO_3$ and 2.81 grams of $Na_2WO_3.2H_2O$ in water and heated 30 minutes at 700° C in air. It was then heated 30 minutes at 500° C in air atmosphere of hydrogen and nitrogen. The anode thus produced was a titanium substrate having on the surface thereof an orange-colored coating of sodium tungsten bronze having a composition corresponding to the formula $Na_{.7}WO_3$ and having a coating weight of 25 grams per square meter.

EXAMPLE IB

An anode prepared as described in example IA was further coated with a 15 percent by weight solution of IrC14 in isopropyl alcohol and fired in air at 650° C for 30 minutes. The resultant outer coating of $IrO_2$ had a coating weight of 2.0 grams per square meter.

EXAMPLE II

The anodes prepared according to examples IA and IB were installed and tested in a chlorine test cell wherein the anode and cathode compartments were separated by an asbestos diaphragm and the anode compartment was supplied with brine having a strength of about 300 grams of NaCl per liter. Operating temperature of the cell was maintained at about 95° C. At a current density of 0.5 amperes per square inch, the anode of example IA, having an outer surface of sodium tungsten bronze, exhibited an initial potential v. a SCE reference electrode, of 1.39 volts, rising to 4.13 volts over a 40 minute period. At a current density of 2.0 amperes per square inch, the anode of example IB exhibited an initial potential, v. a SCE reference electrode, of 1.16 volts and remained essentially constant over a 6 hour period.

The foregoing specification is intended to illustrate the invention with certain preferred embodiments, but it is understood that the details disclosed herein can be modified without departing from the spirit and scope of the invention.

I claim:

1. In a method of electrolyzing aqueous metal chloride solutions, wherein chlorine is liberated at the anode, the improvement consisting essentially of using as said anode, a composite structure comprising a valve metal substrate, a coating thereon of an oxide bronze, and an outer coating of a noble metal oxide selected from the group consisting of an oxide of platinum, iridium, rhodium, palladium, ruthenium, and osmium and mixtures thereof.

2. The improvement according to claim 1 wherein the anode comprises a valve metal substrate, a coating thereon of an alkali metal tungsten bronze, and an outer coating of iridium oxide.

3. The improvement according to claim 2 wherein the alkali metal tungsten bronze is sodium tungsten bronze.

4. The improvement according to claim 3 wherein the valve metal substrate is titanium.

5. An electrode for use in the electrolysis for use of brine, consisting essentially of a valve metal substrate, a coating thereon of oxide bronze, and an outer coating of a noble metal oxide selected from the group consisting of an oxide of platinum, iridium, rhodium, palladium, ruthenium, and osmium and mixtures thereof.

6. An electrode according to claim 5 wherein the valve metal substrate is titanium.

7. An electrode according to claim 5 wherein the oxide bronze is an alkali metal tungsten bronze.

8. An electrode according to claim 5 wherein the noble metal oxide is iridium oxide.

9. An electrode according to claim 6 wherein the alkali metal tungsten bronze is sodium tungsten bronze.

10. An electrode according to claim 5 which comprises a titanium substrate, a coating thereon of sodium tungsten bronze, and an outer coating of iridium oxide.

* * * * *